US005845777A

United States Patent [19]

Najmi

[11] Patent Number: 5,845,777

[45] Date of Patent: Dec. 8, 1998

[54] WATER GLASS REMINDER

[76] Inventor: Boman K. Najmi, 13120 Windcrest Dr., Port Charlotte, Fla. 33953

[21] Appl. No.: 758,885

[22] Filed: Dec. 2, 1996

Related U.S. Application Data

[60] Provisional application No. 60/011,854 Feb. 20, 1996.

[51] Int. Cl.[6] ..... B65D 25/20

[52] U.S. Cl. ..... 206/459.1; 215/386; 116/227; 116/317

[58] Field of Search ..... 215/386; 206/459.1, 206/534; 116/227, 317

[56] References Cited

U.S. PATENT DOCUMENTS

| | | | |
|---|---|---|---|
| 4,877,119 | 10/1989 | Hosking | 206/459 |
| 4,920,912 | 5/1990 | Kirkling | 116/308 |
| 5,046,605 | 9/1991 | Levrant | 206/459.1 X |
| 5,400,907 | 3/1995 | Chen | 206/459.1 |
| 5,433,324 | 7/1995 | Leonard | 206/534 |
| 5,482,163 | 1/1996 | Hoffman | 206/534 |
| 5,644,298 | 7/1997 | Brooks et al. | 206/534 X |

*Primary Examiner*—Stephen K. Cronin
*Attorney, Agent, or Firm*—Frank A. Lukasik

[57] ABSTRACT

A water glass reminder for counting the number of glasses of water consumed each day consisting of a clear plastic ten ounce glass with a rotatable disc or ring for indexing from one number to the other as water is consumed.

4 Claims, 10 Drawing Sheets

15

23
27
22
21
26
20

17
16
25
17
16
26
20
20

WATER GLASS REMINDER

RELATED APPLICATION

This application is a Continuation-In-Part of Provisional patent application Ser. No. 60/011,854, Filed Feb. 20, 1996.

BACKGROUND OF THE INVENTION

1. Field of the Invention

The present invention relates generally to a measuring glass and more particularly to a water glass for counting the number of glasses of water consumed each day.

2. Discussion of the Prior Art

It has been proven by many medical studies that each individual should consume at least 8 ounces of water daily. This consumption of eight ounce glasses of water daily cleanses the digestive system and aids in the function of many organs, such as the kidneys. In addition, the following types of individuals benefit from increased water intake: ill persons are always encouraged to increase their water intake to keep the body from dehydrating;. Some medications require extra water intake also; dieters consume this calorie-free beverage as a way to feel full and discourage frequent eating; and, athletes or persons engaging in any type of physical exercise are encouraged to increase their water intake to replenish fluid loss through perspiration. For the same reason, persons who spend time outdoors in warm climates drink extra water. In summary, there are many benefits of drinking at least eight glasses of water daily.

SUMMARY OF THE INVENTION

It is difficult to keep track of the number of glasses of water consumed daily. It is easy to lose count after consuming two or three glasses. The instant invention provides a unique "counting mechanism" to keep track of the number of glasses of water consumed daily. The invention consists of two parts, a plastic drinking glass, which holds eight ounces of water, and an opaque, rotatable, plastic ring having a window formed therein. The wall of the drinking glass is extended below the bottom of the glass and the numbers 1–8 are printed, equally spaced apart, around the outside circumference of the wall extension. A detent is formed on the ring to mate with notches formed in the plastic ring which act as stops for each numbered position. The plastic ring is assembled over the wall extension and held in position by a pair of ridges formed on the outer periphery of the wall extension. The wall extension is cut to form two tabs which may be depressed when it is necessary to remove the ring from the plastic glass for cleaning.

DESCRIPTION OF THE PREFERRED EMBODIMENT

Figure 1:
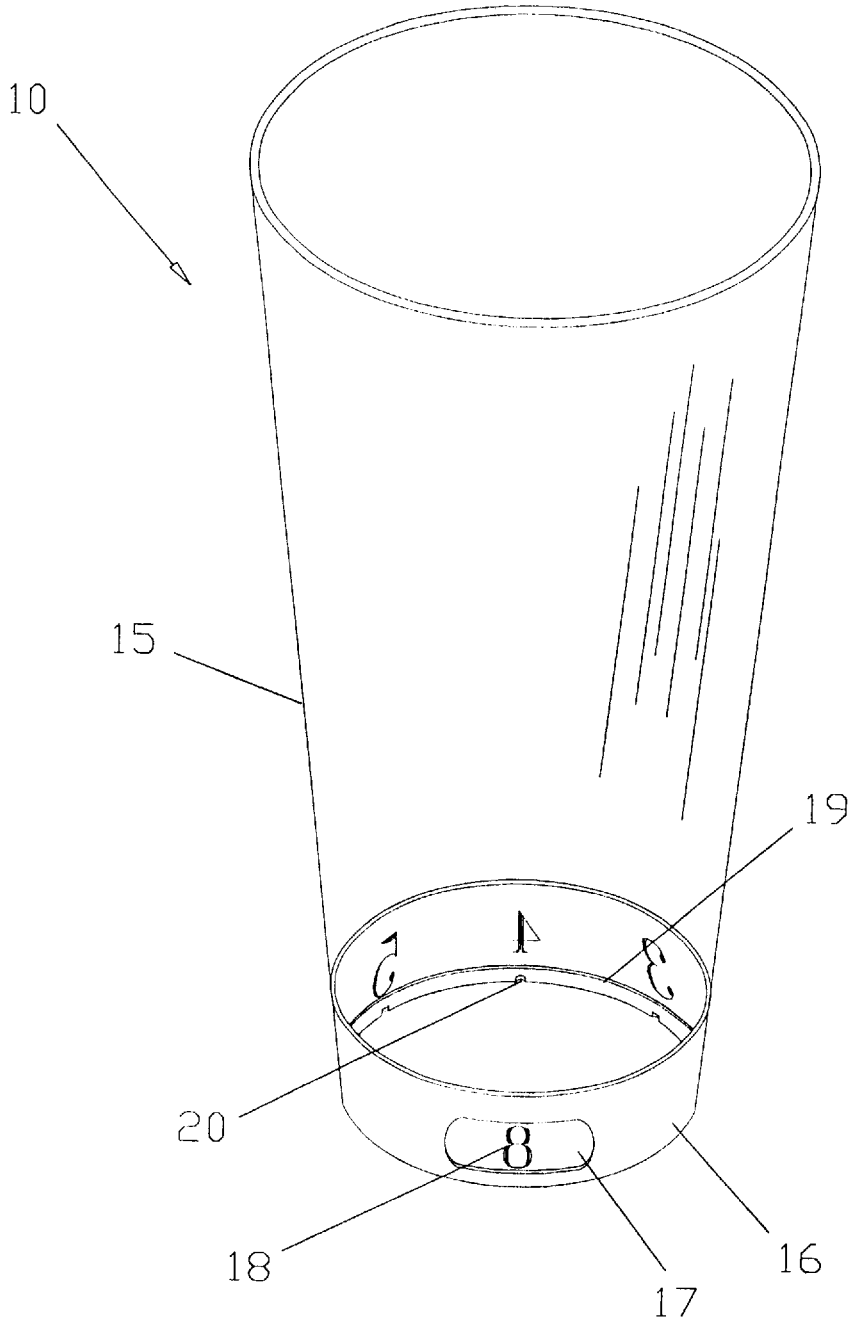
FIG. 1 is a top perspective view of a water glass reminder in accordance with the invention.
Figures 2, 3, 4:
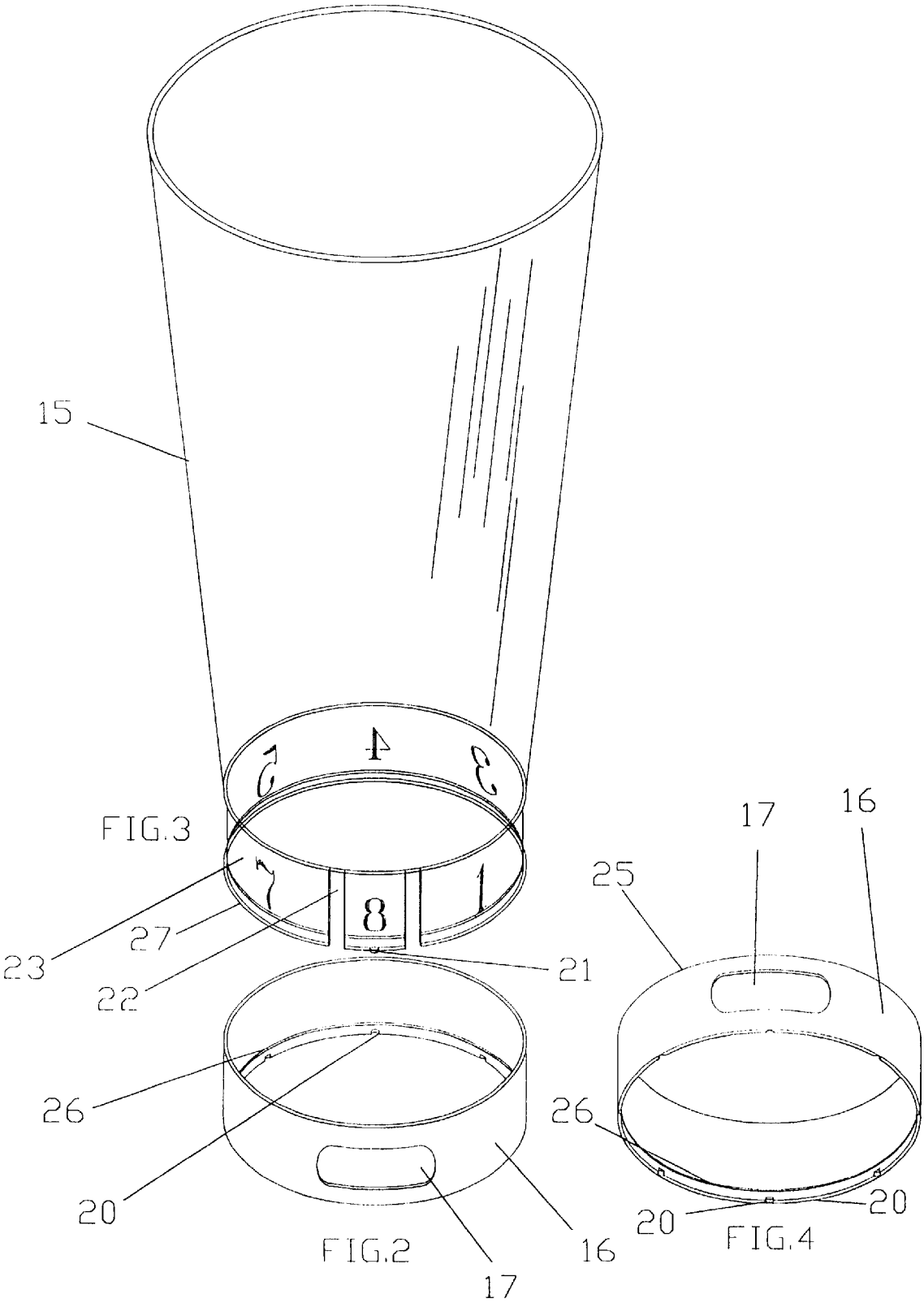
FIG. 2 is a top perspective view of the plastic ring used to indicate the number of glasses consumed.
FIG. 3 is a top perspective view of the drinking glass in accordance with the invention.
FIG. 4 is a bottom perspective view of the plastic ring used in accordance with the invention.
Figure 5:
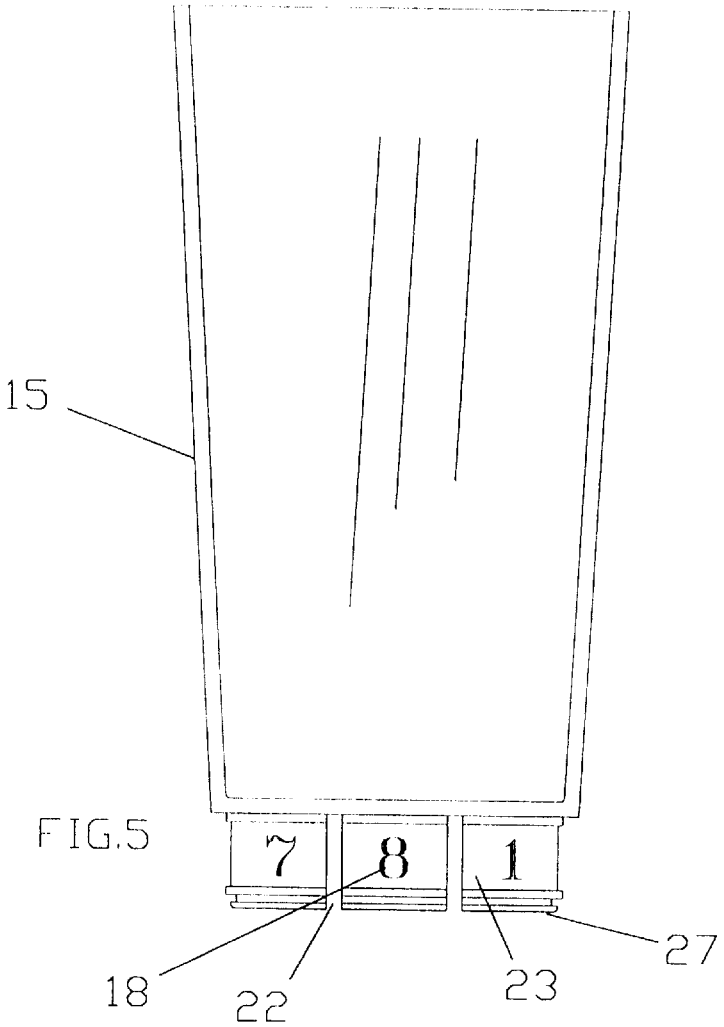
FIG. 5 is a side view of the water glass.
Figure 6:
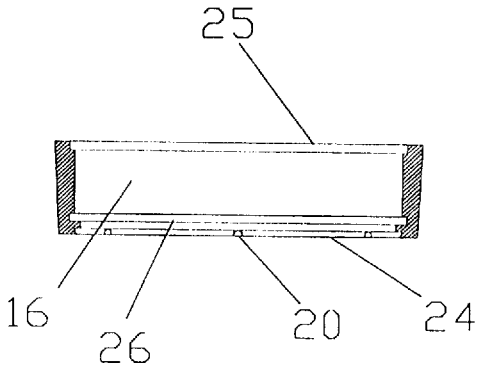
FIG. 6 is a side sectional view of the ring in accordance with the invention.

Referring to the drawings in detail, and referring first to FIG. 1, there is illustrated the water glass reminder of the invention, designated by the numeral 10. Water glass reminder 10 is comprised generally of means for holding a glass of water or other liquid and indicating means for counting the number of glasses of water consumed daily. The water glass reminder 10 of the preferred embodiment comprises a clear plastic ten ounce drinking glass 15 (vessel), and an opaque plastic ring 16. The wall of glass 15 is extended below the bottom of the glass to form a circular base 23 having a plurality of vertical slots 22 formed therein. The outer diameter of the circular base 23 has a smaller diameter than the bottom of glass 15 to accommodate the thickness of the ring 16 when they are assembled together. The plastic ring 16 is tapered from the bottom edge 24 to the top edge 25 and has a top diameter equal to the outside bottom diameter of the glass 15 to provide a continuous line surface from the top of the glass 15 to the bottom edge 24 of ring 16. When assembled, the ring 16 becomes an integral part of the water glass reminder 10. The circumference of the ring 16 has a knurled surface so it is easy to grip and turn.

Images of numbers 1 through 8 are printed on the outside surface of circular base 23 so that one number at a time is visible through the clear window 17 in the ring 16. A circular ridge 26 is formed on the inside surface of ring 16 and two circular ridges, lower ridge 27 and upper ridge 28 are formed on the outside surface of circular base 23. Eight equally spaced notches 20 are formed in bottom edge 24 beginning with a position near the midpoint of window 17 and continuing around the outer edge 24 at a distance between each other equal to the distance between the numbers 18. A detent 21 is formed on the lower ridge 27 of ring 16 to engage the notches 20 to provide a stop at each of the numbered positions.

The water glass reminder 10 is assembled by placing the ring 16 over the lower ridge 27 and continuing to urge the ring 16 closer to the glass 15 until the circular ridge 26 formed on the inside of ring 16 passes over the lower ridge 27 of base 23 and seats itself between lower ridge 27 and upper ridge 28 where the ring 16 is rotatably seated between the two ridges. When the circular ridge 26 of ring 16 is mated with ridge 27 and ridge 28 of circular base 23, the close tolerances built into the ridges and the space between the ridges provides an easily rotatable ring 16 while simultaneously firmly holding the ring in position to give the impression that it is molded into the glass 15.

The plurality of slots 22, formed in circular base 23, provide a flexible portion of the circular base 23 which bends sufficiently to permit assembling the ring 16 onto the base 23 as well as for removing the ring 16 if it is desired to wash the base 23 to clear any accumulation of minerals when washing the water glass reminder 10.

Figure 7:
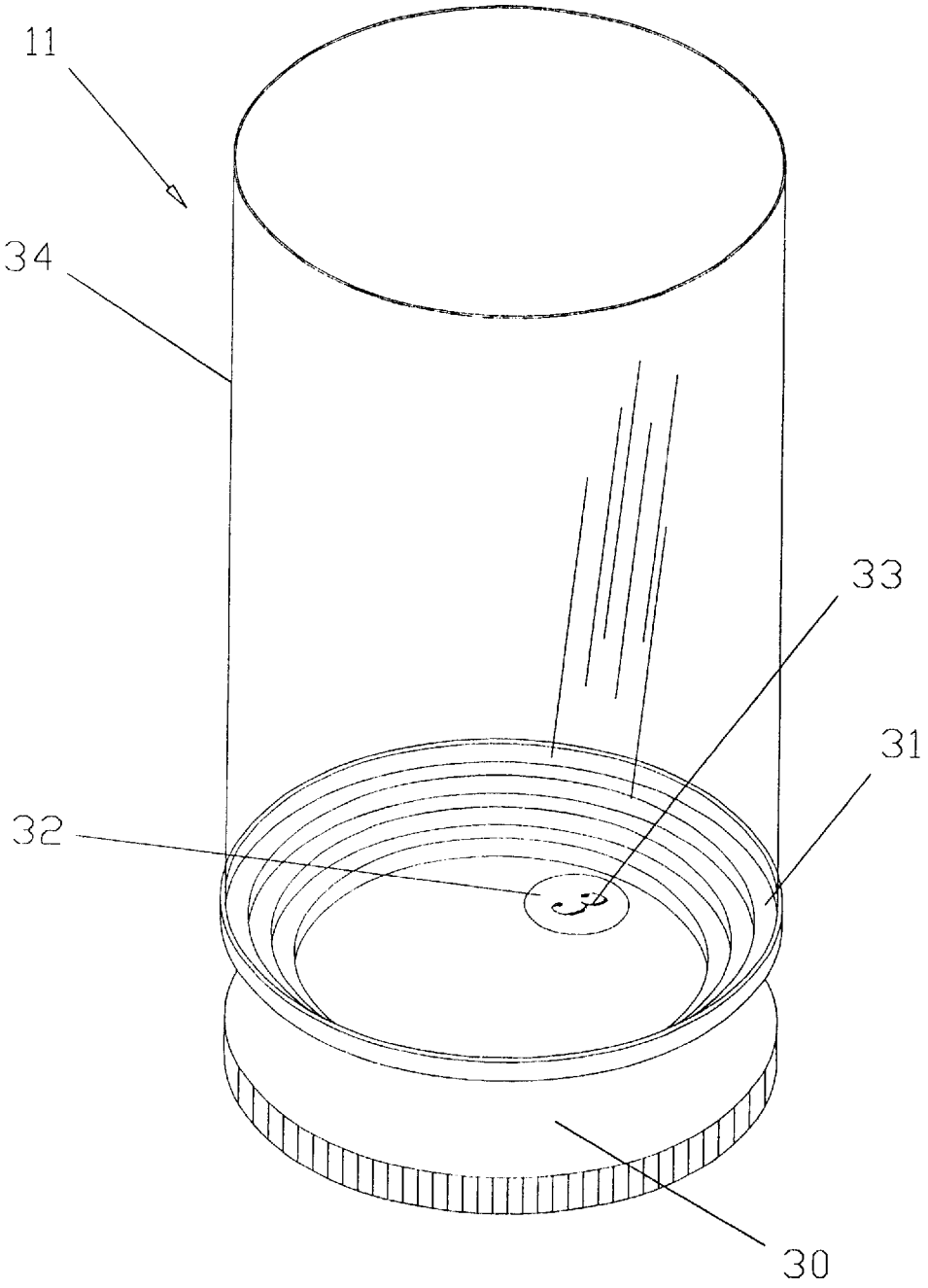
FIG. 7 is a top perspective view of a second embodiment of the water glass reminder in accordance with the invention.
Figure 9:
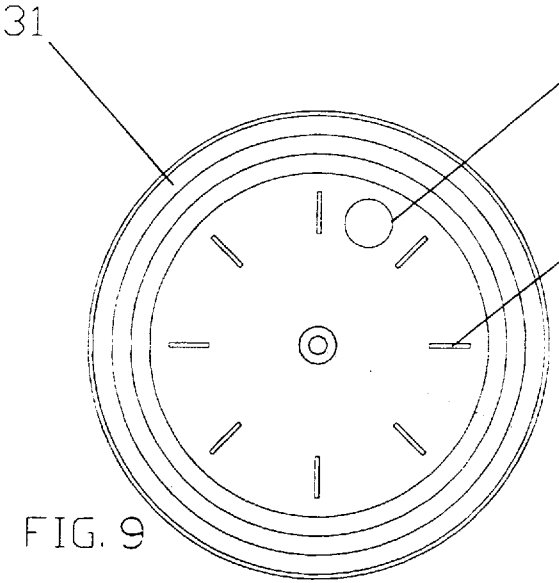
FIG. 9 is a top view of the opaque disc with clear see thru window.
Figure 10:
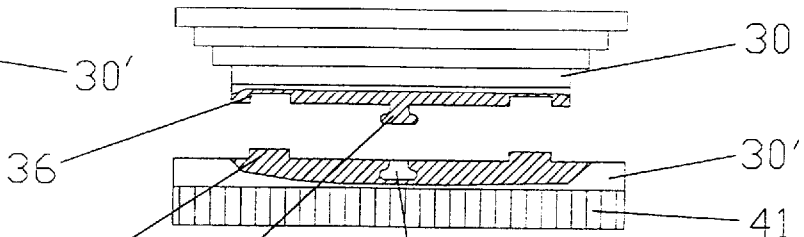
FIG. 10 is a side view, partially in section, of an exploded view of the water glass reminder of the invention.
Figure 8:
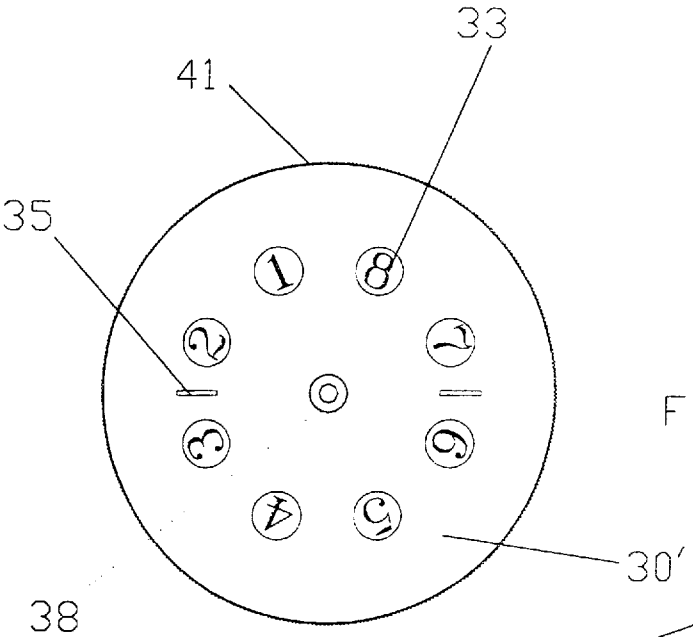
FIG. 8 is a top view of the bottom with numbers.

FIG. 7 shows a coaster type counter mechanism used for the water glass reminder 11 which can be used with different size glasses. The water glass reminder is designed to be used in the manner of a coaster. The counting mechanism is not an integral part of the cup. In this embodiment the counting mechanism is a separate unit that will fit onto the bottom of any size cup or glass. The top 30 has a graduated lip 31 around the edge of the top surface which allows it to fit onto the bottom of any size cup or glass. The only requirement is that a clear cup or glass is used. The top 30 is a clear plastic disc with the entire surface silk screened with opaque ink except a small round area which serves as a clear window 32. Grooves 36 are provided in the top 30. Bottom disc 30' is an opaque plastic disc with images of numbers 1 through 8 printed thereon. This plastic bottom disc 30' has a hole-bearing 38 to receive the shaft 37 of the top 30. The shaft 37 of top 36 is snapped into the plastic bottom 30' thereby creating a vertical axis for rotating the bottom 30'.

Figures 11, 12, 13:
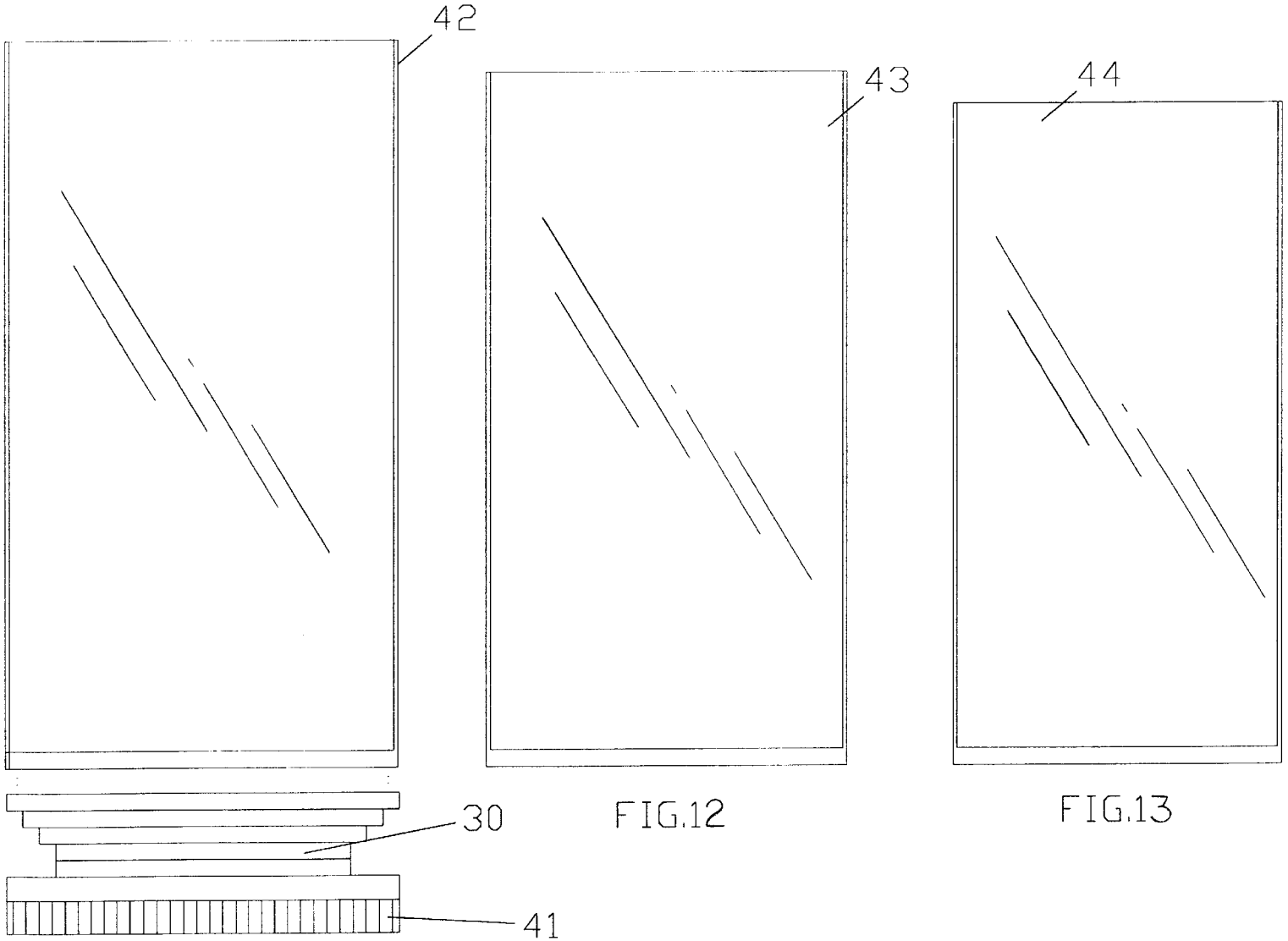
FIG. 11 is a side view of a water glass reminder and a large size glass.
FIG. 12 is a side view of a medium size glass.
FIG. 13 is a side view of a small size glass.
Figure 15:
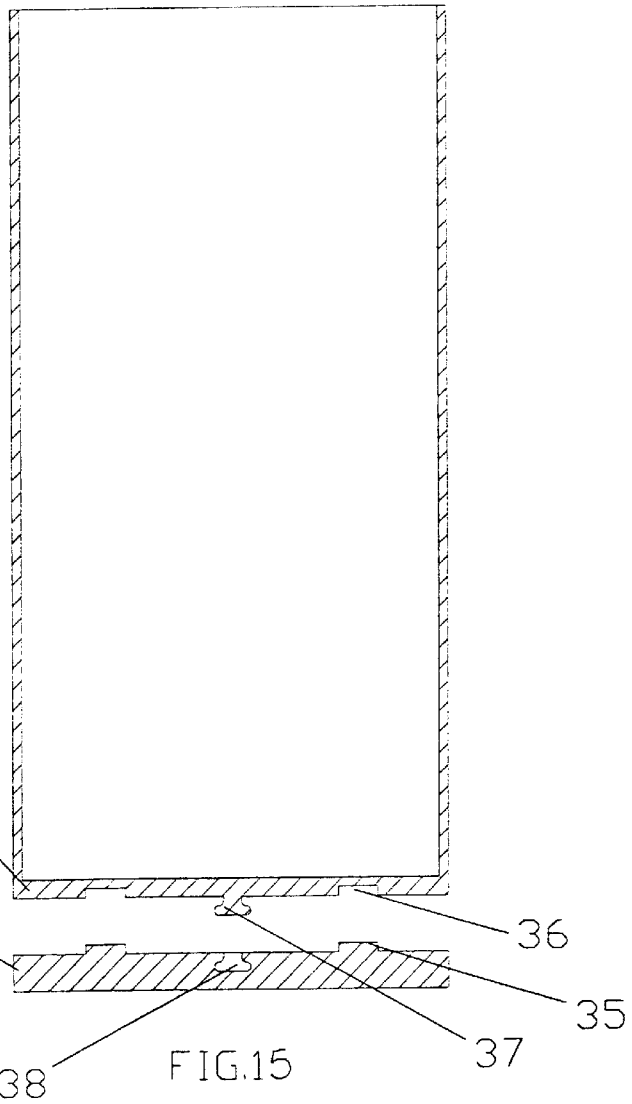
FIG. 15 is an exploded sectional view of the water glass reminder in accordance with the invention.
Figure 14:
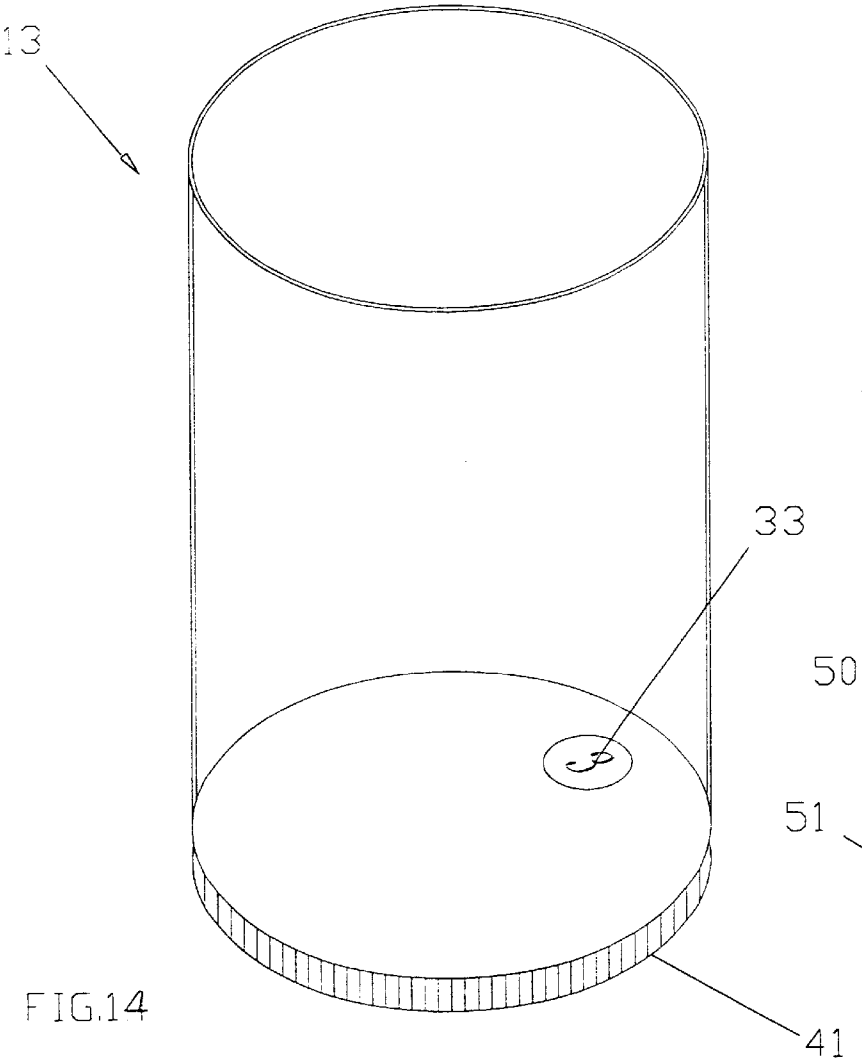
FIG. 14 is a top perspective view of a third embodiment of the water glass reminder in accordance with the invention.
Figure 17:
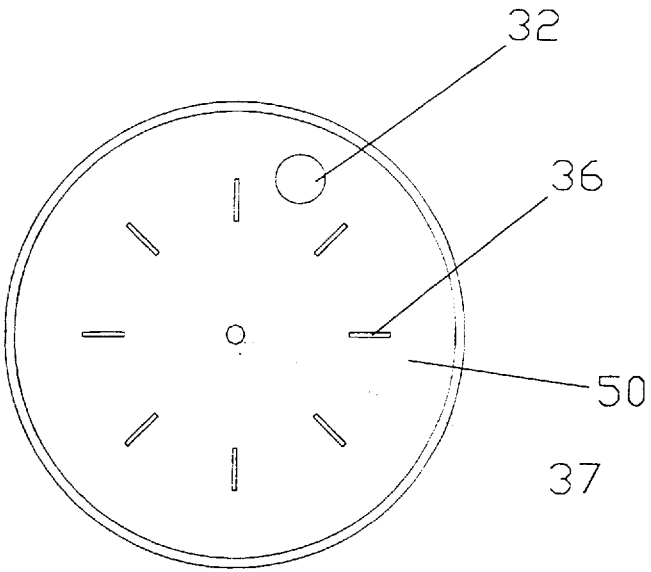
FIG. 17 is a top view of the top of the third embodiment of the invention.
Figure 16:
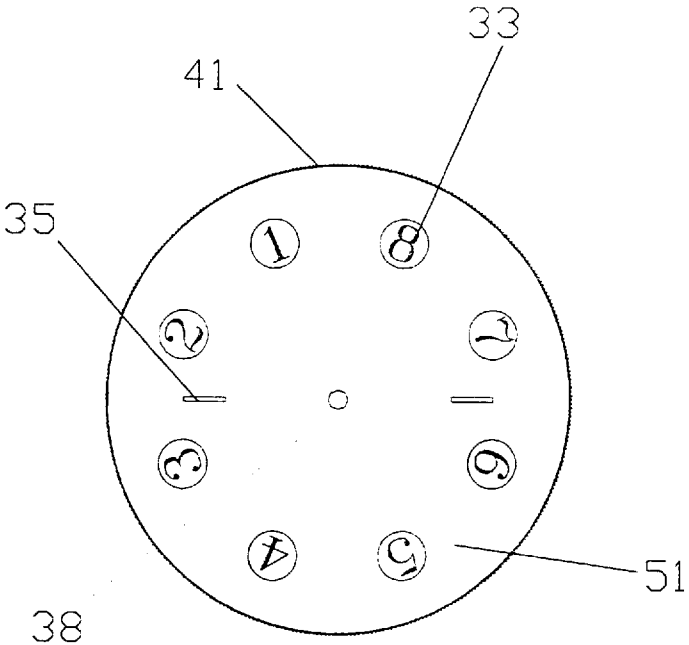
FIG. 16 is a top view of the bottom of the third embodiment of the invention.

The circumference of the bottom 35 has a knurled surface 41 so it is easy to grip and turn to index the numbers 33. Images of numbers 1 through 8 are printed on the face of disc 30' and evenly spaced so that one number at a time is visible through the clear window 32 on top disc 36. Two detents 35 are molded into the top surface of the bottom disc 30'. These detents 35 lock into the grooves 36 on the bottom disc 30'. These detents 35 and grooves 36 act as a clicking mechanism when disc 30' is turned to reveal numbers 1 through 8 in the clear window 32. This clicking action allows for a controlled turning so that a certain amount of force will be required to advance to the next number and prevents accidental turning of disc 30'. FIGS. 11 through 13 show the various size glasses that can be accommodated by the lip 31.

FIGS. 14 through 17 show an alternate embodiment of the water glass reminder wherein the features of the disc 50 are formed into the bottom of the glass 13. The glass 13 is clear with an opaque bottom surface (disc 50) except for the window 32 which is clear to permit viewing of the numbers as the disc 51 is rotated. Two detents 35 are molded into the top surface of the disc 51. These detents 35 lock into the grooves 36 formed in the the disc 50. Bottom disc 51 is an opaque plastic disc with images of numbers 1 through 8 printed thereon. The disc 51 has a hole bearing 38 to receive the shaft 37 formed on disc 50 thereby creating a vertical axis for rotating the bottom disc 50.

Figure 18:
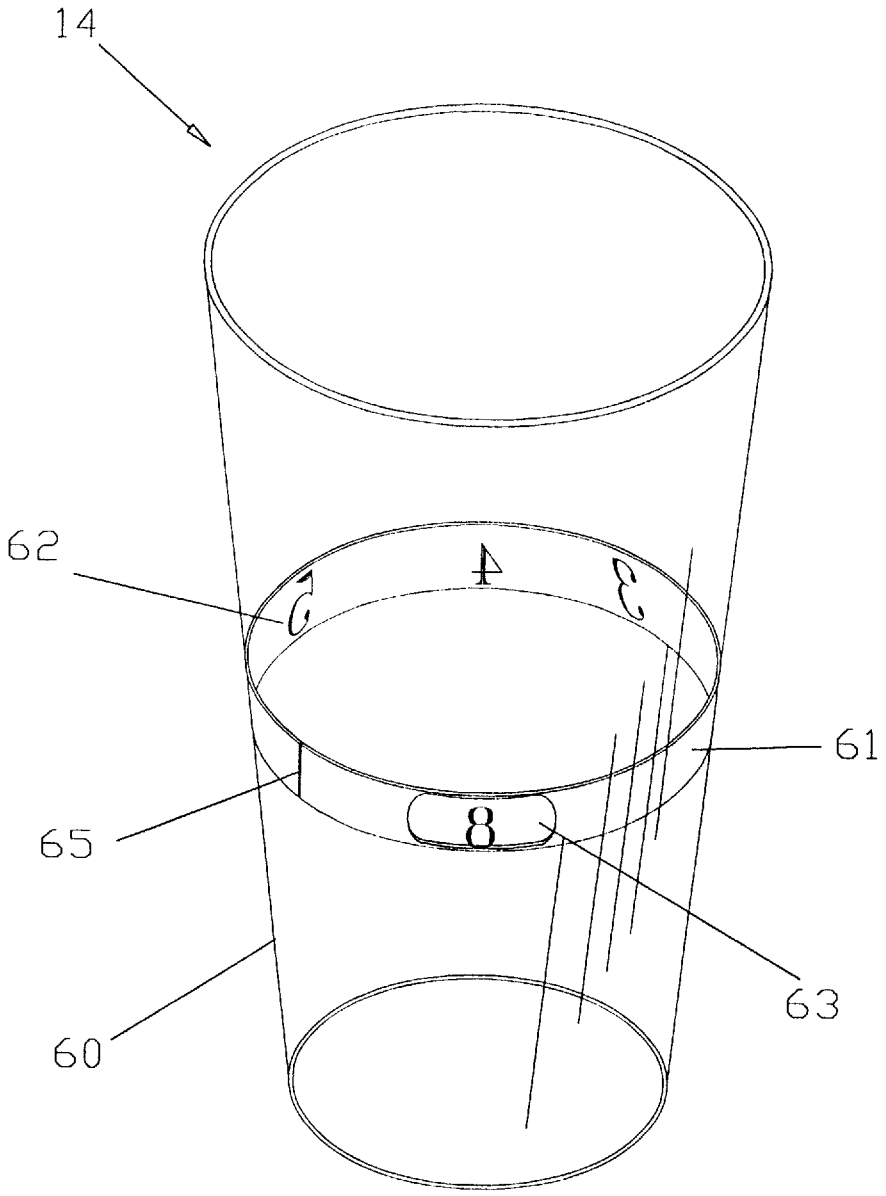
FIG. 18 is a top perspective view of a fourth embodiment of the water glass reminder in accordance with the invention.
Figure 19:
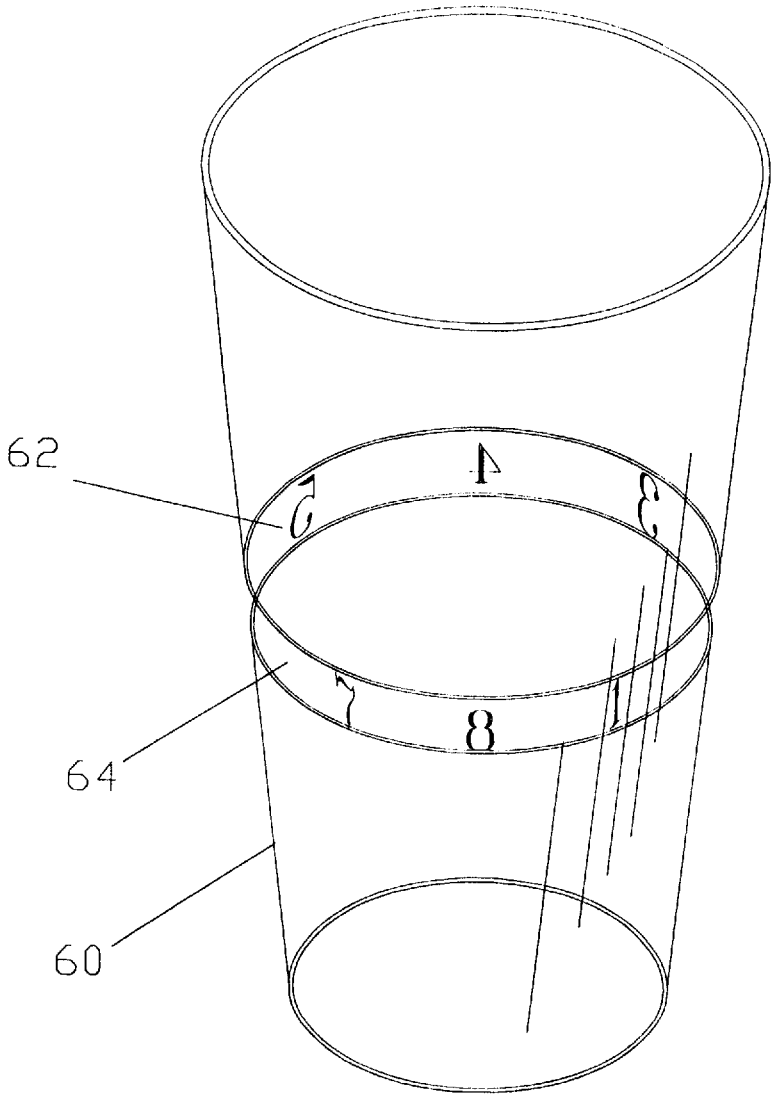
FIG. 19 is a top perspective view of a water glass having a groove formed in the wall of the glass.
Figure 20:
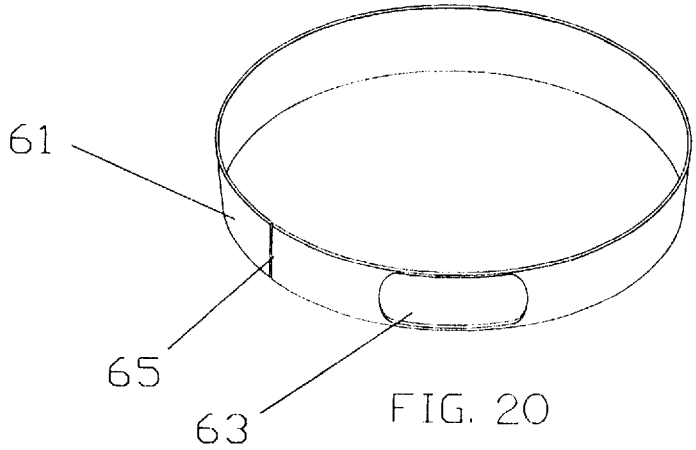
FIG. 20 is a top perspective view of an opaque ring with a window in accordance with the fourth embodiment of the invention.

FIGS. 18 through 20 disclose a ring type alternative embodiment of the drinking glass reminder 14. The glass 60 contains a groove 64 approximately two thirds of the length of the glass 60 from the bottom. The groove is sufficiently wide to hold an opaque ring 61 and sufficiently deep to maintain the ring 61 outer surface, flush with the outer surface of the glass 60. Images of numbers 62 (1 through 8) are printed, equally spaced, around the circumference of the groove 64. Ring 61 has a window 63 formed to provide visibility for each number as the ring 61 is rotated around the glass 60 as each glass of water is consumed. The ring 61 has a vertical slit cut or formed therein to permit the ring 61 to be expanded when installing the ring 61 on the glass 60.

Of course, it should be understood that a wide range of changes and modifications can be made to the preferred embodiment described above. It is therefore intended that the foregoing descriptions be regarded as illustrative rather than limiting, and that it can be understood that it is the following claims, including all equivalents, which are intended to define the scope of the invention.

What is claimed is:

1. A water glass reminder for counting the number of glasses of water consumed each day comprising:

a clear plastic glass for holding a glass of water or other liquid, said glass having an outer bottom surface and a circular base formed on said bottom surface, said said circular base having an outside surface, an inside surface and a bottom edge, images of numbers printed on the outside surface corresponding to the number of glasses of water consumed, an upper ridge and a lower ridge formed on said inside surface, and a detent formed on said outside surface of said bottom edge, and an opaque plastic ring having an inner surface, an outer surface, a top edge and a bottom edge, a circular ridge formed on said inner surface, and a window formed therein for selectively displaying each appropriate image, said bottom edge having notches formed for each of said images of numbers, said plastic ring being rotatably assembled over said circular base and removably held in place by said circular ridges formed on said circular base and said plastic ring.

2. A water glass reminder for counting the number of glasses of water consumed each day comprising:

clear plastic means for holding a glass of water or other liquid, indicating means for counting the number of glasses of water consumed daily, said indicating means consisting of a circular base formed on said clear plastic means, said circular base having an outside surface, an inside surface and a bottom edge, images of numbers printed on the outside surface circumference corresponding to the number of glasses consumed, an upper ridge and a lower ridge formed on said inside surface, and a detent formed on said outside surface of said bottom edge, and selecting means for counting the appropriate number of glasses of water consumed, said selecting means consisting of a rotatable, opaque, plastic ring having an inner surface, an outer surface, a top edge and a bottom edge, a circular ridge formed on said inner surface, said bottom edge having notches formed for each of said images of numbers, and having a window formed therein for selectively displaying each appropriate image, said selecting means being rotatably assembled over said indicating means and removably held in place by said circular ridges formed on said indicating means and said selecting means.

3. A water glass reminder for counting the number of glasses of water consumed each day comprising:

clear plastic means for holding a glass of water or other liquid, said clear plastic means being inserted into a top portion having a graduated lip and a bottom surface silk screened with opaque ink leaving a small, round area clear for providing a clear window, said bottom surface having a plurality of grooves formed therein and a shaft formed at the center, and said selecting means consisting of an opaque, plastic disc having images of numbers one through eight printed on a top surface, a hole-bearing formed thereon for rotatably engaging said shaft, and a pair of detents for engaging said grooves as said disc is rotated one position for each glass of liquid consumed.

4. A water glass reminder for counting the number of glasses of water consumed each day comprising:

clear plastic means for holding a glass of water or other liquid, said clear plastic means consisting of a liquid portion and a bottom portion, said bottom portion having a bottom surface silk screened with opaque ink leaving a small, round area clear for providing a window, said bottom surface having a plurality of grooves therein and a shaft formed at the center thereof, and said selecting means consisting of an opaque, plastic disc having images of numbers one through eight printed on a top surface, a hole-bearing formed thereon for rotatably engaging said shaft, thereby forming a vertical axis for rotating said disc, and a pair of detents for engaging said grooves as said disc is rotated one position for each glass of water consumed.

* * * * *